United States Patent [19]

Bader et al.

[11] Patent Number: 4,987,276

[45] Date of Patent: Jan. 22, 1991

[54] DECELERATION SWITCH

[75] Inventors: Heinz Bader, Karlshuld; Georg Sterler, Grobmehring, both of Fed. Rep. of Germany

[73] Assignee: Audi AG, Ingolstadt, Fed. Rep. of Germany

[21] Appl. No.: 404,413

[22] Filed: Sep. 8, 1989

[30] Foreign Application Priority Data

Sep. 9, 1988 [DE] Fed. Rep. of Germany ..... 3830782

[51] Int. Cl.[5] ..... H01H 35/14

[52] U.S. Cl. ..... 200/61.45 M; 200/61.53; 335/205

[58] Field of Search ..... 200/61.45 R, 61.45 M, 200/61.53; 335/205, 206, 207

[56] References Cited

U.S. PATENT DOCUMENTS 3,795,780 5/1974 Lawrie ..... 200/61.45 R 4,705,922 11/1987 Seeger et al. ..... 200/61.45 M 4,873,401 10/1989 Ireland ..... 200/61.45 M 4,877,927 10/1989 Reneau ..... 200/61.45 M

*Primary Examiner*—J. R. Scott

*Attorney, Agent, or Firm*—Lalos & Keegan

[57] ABSTRACT

A deceleration switch comprising a support member, a permanent magnet mounted on the support member and displaceable from a first position to a second position by inertia caused by a predetermined deceleration of the support member, a spring mounted on the support member for biasing the permanent magnet toward the first position, a set of electrical contacts mounted on the support member and operable to close under the influence of the magnetic field of the permanent magnet when the permanent magnet is in the second position and an inductive device energized to produce a second magnetic field enhancing the magnetic field of the permanent magnet thus causing the contacts to remain closed for a longer period of time upon return of the permanent magnet to its first position under the biasing action of the spring.

4 Claims, 2 Drawing Sheets

DECELERATION SWITCH

BACKGROUND OF THE INVENTION

This invention relates to switches and more particularly to an electrical switch suitable for use in an electrical circuit operable for actuating the inflation of an airbag in a motor vehicle.

In the prior art, electrical circuits operable for actuating the inflation of airbags in vehicles have utilized mercury switches for actuating inflation mechanisms. In such switches, there typically has been provided an inclined tube having a globule of mercury normally positioned at a lower front end thereof and a set of electrical contacts at an upper rear end thereof. Whenever the vehicle is caused to decelerate rapidly, as upon impact, inertia causes the mercury globule to displace rearwardly and interconnect the set of contacts thus closing the airbag inflation actuating circuit. Such switches, however, have been found not to be entirely satisfactory in that the closing time is adversely affected by the surface tension of the mercury which has the effect of the mercury globule adhering to the contacts.

More recently, there has been developed an improved switch for such circuitry consisting of a tubular member provided with a pair of circular end plates having diameters greater than the diameter of the tubular member, a pair of reed relay contacts, each mounted on an end plate, projecting inwardly therefrom substantially axially relative to the tubular member and having the inner opposed ends thereof normally spaced apart transversely, an annular permanent magnet mounted on the tubular member and freely displaceable along a portion of the length thereof, and a helical spring mounted on the tubular member and between one end plate and the annular permanent magnet to yieldably bias the permanent magnet away from a point along the tubular member at which the magnetic field of the magnet would cause the reed contacts to engage and thus close a circuit. In the operation of such switches, whenever the vehicle incurs a sudden deceleration, such as upon impact, the inertia of the permanent magnet will cause it to displace forwardly along the length of the tubular member, against the biasing action of the helical spring, to a position where the magnetic field of the magnet causes the reed contacts to close.

The principal disadvantage of such switches is that their closing times are considerably less than those of mercury switches. In principle, it would be possible to increase the closing times of such switches by increasing the mass of the permanent magnet or by decreasing the biasing force. This, however, would result in the response threshold for the switches to approach lower decelerations. The switch would become more sensitive and thus not be effective for safety switch applications. It thus has been found to be desirable to provide such a switch in which the time in which the contacts are closed is increased without correspondingly decreasing the response threshold time.

Accordingly, it is the principal object of the present invention to provide an improved electrical switch.

Another object of the present invention is to provide an improved electrical switch suitable for use in electrical circuitry operable for actuating the inflating mechanism of an airbag of a vehicle.

A further object of the present invention is to provide an improved deceleration switch suitable for use in vehicle airbag systems.

A still further object of the present invention is to provide an improved deceleration switch for use in a vehicle airbag system in which a magnetic element is adapted to displace against the biasing force of a spring upon a predetermined deceleration of the vehicle, as upon impact, to close a set of contacts in which the closing time of the switch is increased without correspondingly decreasing the response threshold time of the switch.

BRIEF DESCRIPTION OF THE DRAWINGS

Other objects and advantages of the present invention will become more apparent to those persons having ordinary skill in the art to which the present invention pertains from the following description taken in conjunction with the accompanying drawings, wherein.

DESCRIPTION OF THE PREFERRED EMBODIMENT

Figure 1:
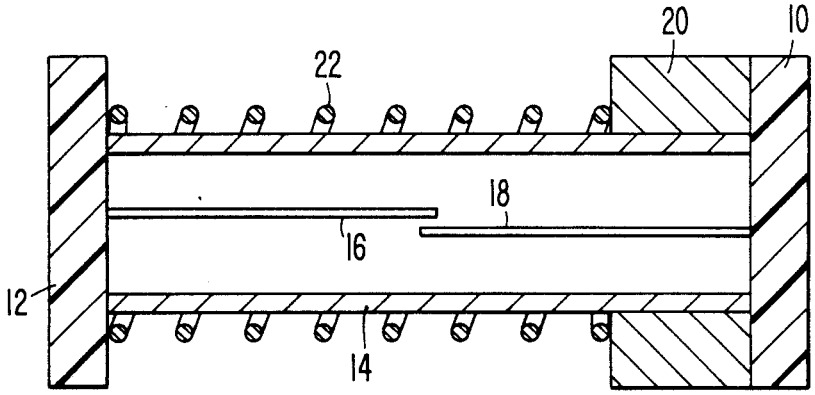
FIG. 1. (PRIOR ART)
FIG. 1 is a vertical cross-sectional view of a conventional deceleration switch of the prior art utilizing a set of reed relay contacts.

Referring to FIG. 1, there is illustrated a conventional deceleration switch of the type described. The switch includes a non-magnetic tubular member 14 having a circular end plate 10 mounted on a rear end thereof and a circular end plate 12 mounted on a front end thereof. Each of the end plates has a diameter greater than the diameter of the tubular member to provide a pair of opposed annular surfaces. Mounted on tubular member 14 and engageable with rear end plate 10 is an annular permanent magnet 20 which is adapted to be freely displaced along a portion of the length of the tubular member. A helical spring 22 encompasses the tubular member and is interposed between the annular surface of front end plate 12 and a front annular face of magnet 20 for yieldably biasing the magnet in a position as shown in FIG. 1 against rear end plate 10.

Provided within the tube member is a set of contacts 16 and 18 that are adapted to be closed under the influence of the magnetic field of magnet 20. The contacts are provided on reed type elements that are mounted on end plates 10 and 12, project inwardly relative thereto substantially along the axis of the tubular member and are adapted to be electrically connected to a circuit for operating an actuating mechanism for an airbag system of a vehicle. In the position as shown in FIG. 1, the magnetic field of the magnet will be too far removed from contacts 16 and 18 to cause them to close. However, when the switch incurs a predetermined deceleration, as during an impact of the vehicle, the inertia of the magnet will cause it to displace to the left relative to FIG. 1, against the biasing action of spring 22, to a position wherein the magnetic field of the magnet will cause contacts 16 and 18 to close. Upon dissipation of the force of inertia caused by the predetermined deceleration, spring 22 will operate to exert a return force on the magnet and return it to the position as shown in FIG. 1.

During the operation of the switch as shown in FIG. 1, the dwell time of the positioning of the magnet so as to cause contacts 16 and 18 to close is insufficient to provide an effective energization of the circuitry for the airbag actuating mechanism.

Figure 2:
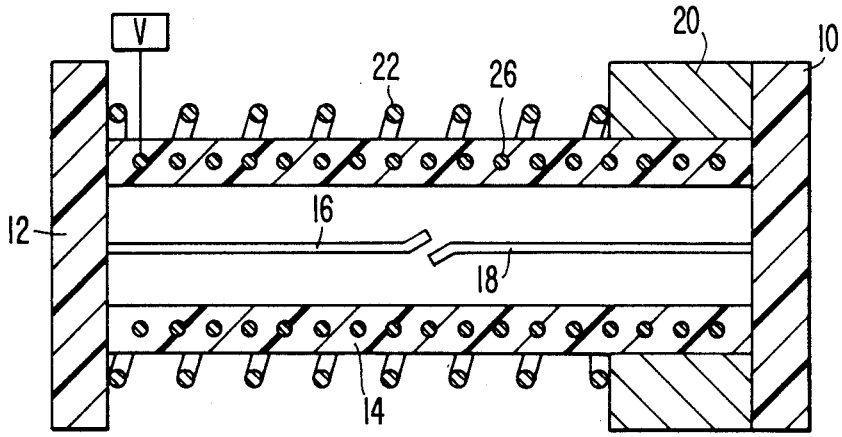
FIG. 2 is a vertical cross-sectional view of a switch similar to the switch shown in FIG. 1, embodying the present invention.

FIG. 2 illustrates a modification of the switch shown in FIG. 1 which embodies the present invention. The embodiment includes an electrical coil 24 embedded in a non-magnetic tube member 14. Coil 24 is electrically energized by means of voltage source V to enhance the magnetic field produced by the permanent magnet thus accelerating the closing action of contacts 16 and 18 and prolonging the time of closure of such contacts. Coil 24 is designed in a manner so that the magnetic field produced by the coil is insufficient independently to cause contacts 16 and 18 to close. The closing of contacts 16 and 18 can be effected only by the combined magnetic fields of permanent magnet 20 and coil 24.

Figure 3:
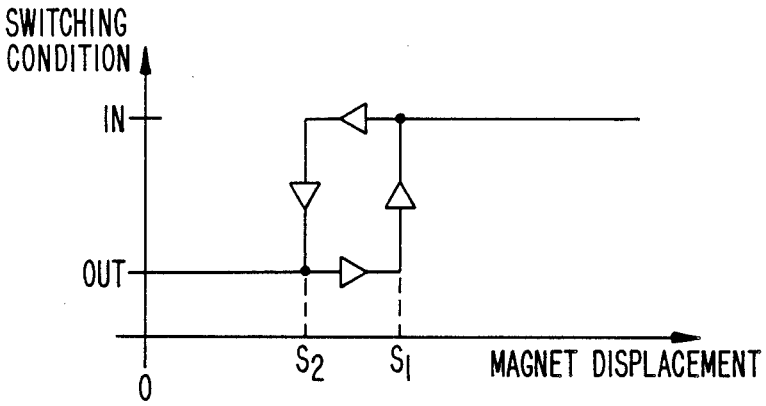
FIG. 3 is a graphical representation of the operation of the switch shown in FIG. 2, illustrating the switching condition as a function of magnet displacement.

The superimposing of the magnetic field produced by coil 24 on the magnetic field produced by the permanent magnet when displaced to the vicinity of contacts 16 and 18 provides a hysteresis effect as illustrated in FIG. 3. Referring to FIG. 3, the permanent magnet must be displaced a distance $S_1$ before contacts 16 and 18 are closed, and the contacts will remain closed as long as the displacement of the magnet is greater than the distance $S_1$. Upon the return of the magnet to the position as shown in FIG. 1, the contacts will remain closed due to the additionally applied magnetic field provided by coil 24. The contacts will open only when the magnet is displaced by distance $S_2$. Under such conditions, the contacts will remain closed for a longer period of time thus assuring energization of the circuitry for the actuating means of the airbag system.

Figure 2A:
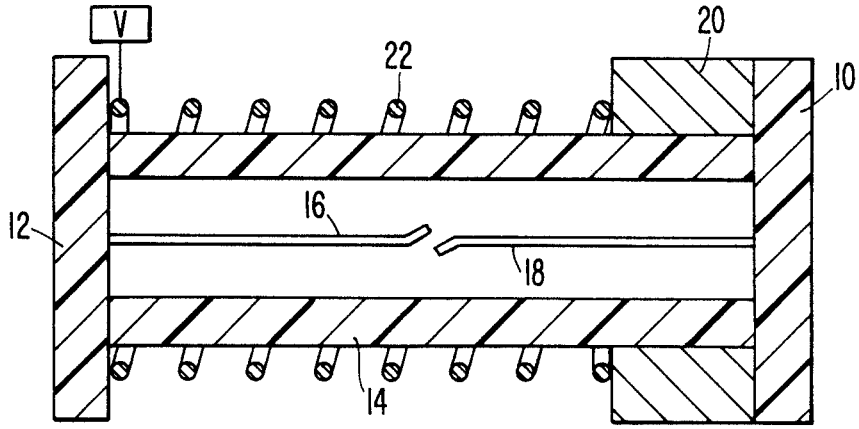
FIG. 2A is a vertical cross-sectional view of the switch similar to the switch shown in FIG. 2, illustrating a preferred embodiment.

As a modification of the embodiment shown in FIG. 2 and as shown in FIG. 2A, coil 24 may be dispensed with and helical spring 22 may be utilized to provide the secondary magnetic field. This may be accomplished merely by forming helical spring 22 of an electrically conducting material capable of producing a magnetic field and electrically connecting it to a voltage source V.

Figure 4:
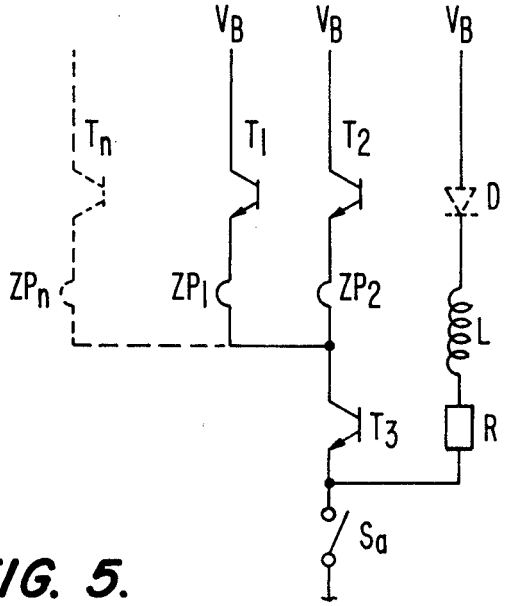
FIG. 4 is a schematic of a circuit utilizing a switch embodying the present invention.

FIG. 4 illustrates a release system for an airbag utilizing a type of switch as shown in FIG. 2. In such a system, transistors $T_1, T_2 \ldots T_n$ are connected to electrical sensors with high delay values for releasing airbags installed in motor vehicles in the event of a collision. In addition, there is provided an ignition transistor $T_3$ which is connected in series with the parallel connections of transistors $T_1$ through $T_n$. In the individual parallel branches of the transistors $T_1$ through $T_n$, there is provided priming caps $ZP_1, ZP_2 \ldots ZP_n$. The ignition of such priming caps requires the selective ignition of transistors $T_1, T_2 \ldots T_n$ connected in parallel as well as common ignition transistor $T_3$ connected in series therewith.

For safety reasons, a deceleration switch $S_a$ is provided which may consist of a switch as shown in FIG. 2. Only through actuation of the sensor operatively connected to ignition transistor $T_3$ and the deceleration switch is a release of the airbag possible. The deceleration switch $S_a$ has one terminal connected to the ground connected transistor $T_3$ and the other terminal connected to ground.

The deceleration switch $S_a$ is switched on through a switching circuit connected between a supply voltage and the joint connection point of transistor $T_3$ and switch $S_a$. The circuit includes a diode D having the anode thereof facing the voltage supply. Current flows through diode D and is added to by current from switch $S_a$, to an inductance L and possibly a resistance $R_1$, to act as a current limiter.

The circuit shown in FIG. 4 functions as follows. After closing of the deceleration switch $S_a$, a constant current flows through inductance L having a value of:

$$\frac{V_B}{R}$$

This flow through inductance L produces a magnetic field which increases the closing time of the switch contacts. The ground connection of diode D to inductance L prevents the spanning of switch $S_a$. To provide electronic control of the increase of closing time of the contacts through the use of transistor $T_3$, transistor $T_3$ and switch $S_a$ may be interchanged.

Figure 5:
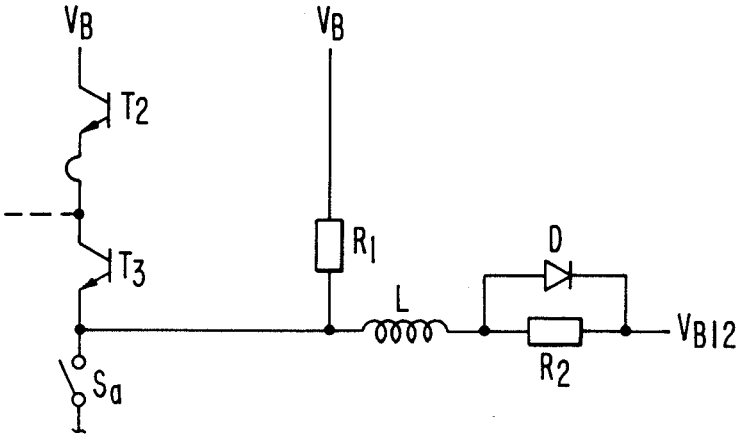
FIG. 5 is a schematic of another circuit utilizing a switch embodying the present invention.

FIG. 5 illustrates a circuit for polarity reversal. A further increase in closing time may be achieved by having the additional magnetic field counteracting the magnetic field of the permanent magnet when the reed contacts are open, and supporting the field of the magnet when the reed contacts are closed.

The supply voltage at the common point of switch $S_a$ and the ignition transistor $T_3$ is provided from two sources. It is provided through resistance $R_1$ connected to a voltage supply $V_B$ and also through a series connection of resistance $R_2$ and inductance L connected to a supply voltage equal to one-half of supply voltage $V_B$, i.e., $V_B/2$. In parallel connection to resistance $R_2$, is a diode D positioned so that the anode thereof is connected to supply voltage $V_B/2$.

When switch $S_a$ is opened, current equal to:

$$\frac{V_B}{2R_1}$$

flows through inductance L, and diode D will be conducting. When the switch is closed, current through inductance L is equal to:

$$\frac{V_B}{2R_2}$$

and the direction of current flow will be reversed.

The sensitivity of the on and off switching and the closing time of $S_a$ can be regulated through the selection of various values for $R_1$ and/or $R_2$. The dynamic or static addressing behavior of the switch also may be optimized in an independent fashion.

Partial voltages other than a half supply voltage may be used for the partial voltages described in connection with the circuit shown in FIG. 5.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A deceleration switch comprising:

a support means;

a first means for producing a first magnetic field mounted on said support means and displaceable between a first position and a second position by inertia caused by a predetermined deceleration of said support means;

means mounted on said support means for biasing said first magnetic field producing means into said first position;

a set of electrical contacts mounted on said support means and operable to close under the influence of the magnetic field of such first magnetic field producing means when said first magnetic field producing means is in said second position; and second means for producing a second magnetic field for enhancing said first magnetic field to accelerate the closing of said contacts and prolong the closure time of said contacts, said second means being disposed along said first and second positions, wherein the field strength of said second magnetic field is insufficient independently to close said contacts.

2. A deceleration switch according to claim 1 wherein said contacts are provided on a reed relay type housing.

3. A deceleration switch according to claim 1 wherein said second means for producing a second magnetic field comprises an inductance coil.

4. A deceleration switch according to claim 3 wherein said second magnetic field is produced by said biasing means comprising a helical spring adapted to be energized upon closure of said contacts.

* * * * *

UNITED STATES PATENT AND TRADEMARK OFFICE

CERTIFICATE OF CORRECTION

PATENT NO. :4,987,276

DATED :January 22, 1991

INVENTOR(S) :Heinz Bader and Georg Sterler

It is certified that error appears in the above-identified patent and that said Letters Patent is hereby corrected as shown below:

COLUMN 6;
claim 3, line 14, after "1" insert --or 2--.

Signed and Sealed this

Twenty-sixth Day of May, 1992

*Attest:*

DOUGLAS B. COMER

*Attesting Officer*

*Acting Commissioner of Patents and Trademarks*